US007252549B2

(12) United States Patent
Nishio et al.

(10) Patent No.: US 7,252,549 B2
(45) Date of Patent: Aug. 7, 2007

(54) CONNECTOR, RECEPTACLE FOR CONNECTOR AND PLUG FOR CONNECTOR

(75) Inventors: Atsushi Nishio, Tokyo (JP); Takashi Kawasaki, Tokyo (JP); Masashi Ouchi, Tokyo (JP); Takahiro Shimoyama, Tokyo (JP)

(73) Assignee: Mitsumi Electric Co., Ltd., Yamagata (JP)

( * ) Notice: Subject to any disclaimer, the term of this patent is extended or adjusted under 35 U.S.C. 154(b) by 0 days.

(21) Appl. No.: 11/477,885

(22) Filed: Jun. 29, 2006

(65) Prior Publication Data

US 2007/0054553 A1 Mar. 8, 2007

(30) Foreign Application Priority Data

Sep. 2, 2005 (JP) ..... 2005-255588

(51) Int. Cl.
*H01R 13/648* (2006.01)

(52) U.S. Cl. ..... 439/607; 439/677; 439/680

(58) Field of Classification Search ..... 439/607, 439/680, 677

See application file for complete search history.

(56) References Cited

U.S. PATENT DOCUMENTS 6,280,251 B1 * 8/2001 Nishio et al. ..... 439/607
6,508,678 B1 * 1/2003 Yang ..... 439/677
6,695,650 B2 * 2/2004 Mueller ..... 439/680

* cited by examiner

*Primary Examiner*—Tho D. Ta
(74) *Attorney, Agent, or Firm*—Patents+TMS, P.C.

(57) ABSTRACT

A connector includes a receptacle 1 to be mounted on a substrate 11 and a plug 5 adapted to be connected to the receptacle 1. The receptacle 1 has a shield case 2 provided with connection terminals 31 therein, and the plug 5 has a shield case 6 provided with connection terminals 71 therein. The shield case 6 of the plug 5 is adapted to be inserted into the shield case 2 of the receptacle 1 when the plug 5 is connected to the receptacle 1, at which the connection terminals 71 of the plug 5 are electrically connected to the connection terminals 31 of the receptacle 1. A tongue portion 23 is provided on a bottom surface of the shield case 2 of the receptacle 1 and a recess 63 is formed on a bottom surface 61 of the shield case 6 of the plug 5 so that the tongue portion 23 is fitted into the recess 63 when the plug 5 is connected to the receptacle 1, which serve as an erroneous insertion preventing and guiding mechanism.

3 Claims, 8 Drawing Sheets

CONNECTOR, RECEPTACLE FOR CONNECTOR AND PLUG FOR CONNECTOR

This application claims the benefit of Japanese Patent Application No. 2005-255588 filed Sep. 2, 2005.

BACKGROUND OF THE INVENTION

1. Field of the Invention

The present invention relates to a connector, a receptacle for connector and a plug for connector, and more specifically relates to a connector comprised of a receptacle and a plug, the receptacle for use in the connector and the plug for use in the connector.

2. Description of the Background Art

In general, a small-sized connector comprised of a receptacle and a plug is provided with an erroneous insertion preventing means for preventing the plug from being inserted into the receptacle in an improper orientation, e.g., in an inverted orientation (Hereinbelow, referred to as "erroneous insertion").

As an example of such an erroneous insertion preventing means, there is known a method in which a pair of erroneous insertion preventing protrusions are formed below a plug insertion opening of a shield case of the receptacle.

Other known methods include a method in which the top, bottom, left and right portions of a plug shield case and a receptacle shield case are formed asymmetrically, and a method in which the upper corner portions of a plug shield case and the upper corner portions of a receptacle shield case are formed into "C"-shaped surfaces as is the case in a mini-USB connector.

However, the methods mentioned above in turn involve such problems as follows. Namely, in the method in which the erroneous insertion preventing protrusions are provided below the plug insertion opening, the width or height of the receptacle is unavoidably increased in proportion to the size of each protrusion, thus leading to a problem in that it is difficult to further reduce the size of the connector.

Further, in the method in which the upper corner portions of the receptacle shield case and the plug shield case are respectively formed so as to have the "C"-shaped surfaces, no measure is taken to sufficiently cope with the situation that the plug is slantingly inserted into the receptacle. Another problem is that, when the connector is of a smaller size, the plug may sometimes be forcibly inserted into the receptacle in an inverted orientation, despite the provision of such "C"-shaped surfaces.

SUMMARY OF THE INVENTION

In view of the above problems involved in the prior art connectors, it is an object of the present invention to provide a connector that can reliably prevent a plug from being erroneously or slantingly inserted into a receptacle, even if the connector is of a smaller size.

In order to achieve the above object, one aspect of the present invention is directed to a connector which includes a receptacle to be mounted on a substrate and a plug adapted to be connected to the receptacle. The receptacle includes a shield case of a generally angulate tubular shape having a bottom surface which is adapted to face the substrate when the receptacle is mounted thereon, and the shield case of the receptacle is provided with connection terminals therein. The plug includes a shield case of a generally angulate tubular shape having a bottom surface, and the shield case of the plug is also provided with connection terminals therein. The shield case of the plug is configured so that the shield case of the plug is inserted into the shield case of the receptacle when the plug is connected to the receptacle, at which the connection terminals of the plug are adapted to be electrically connected to the connection terminals of the receptacle. The connector further includes erroneous insertion preventing and guiding means provided in the bottom surface of the shield case of the receptacle and the bottom surface of the shield case of the plug for preventing any occurrence of erroneous insertion therebetween when the plug is connected to the receptacle while properly guiding the shield case of the plug into the shield case of the receptacle.

According to the connector of the present invention described above, the erroneous insertion preventing and guiding means is provided in the bottom surface of the shield case of the receptacle and the bottom surface of the shield case of the plug, the erroneous insertion preventing means prevents any occurrence of erroneous insertion when the plug is connected to the receptacle while properly guiding the shield case of the plug into the shield case of the receptacle. Accordingly, there is no need to form erroneous insertion preventing protrusions at below an insertion opening of the receptacle from which the plug is inserted into the shield case of the receptacle or at other locations like the prior art described above. This eliminates the need to provide a separate space for forming the erroneous insertion preventing protrusions. The space for providing the erroneous insertion preventing and guiding means can be provided in the bottom surfaces of the shield case of the receptacle and the shield case of the plug, which helps to make the receptacle (connector) to have lower height and smaller size.

In the connector of the present invention, it is preferred that the erroneous insertion preventing and guiding means includes at least one tongue portion formed in one of the bottom surfaces of the shield case of the receptacle and the shield case of the plug and a recess corresponding to the tongue portion and formed on the other bottom surface of the shield case of the receptacle or the shield case of the plug, the tongue portion is fitted into the recess when the plug is connected to the receptacle.

According to the connector of the present invention described above, the tongue portion interferes with the portions other than the recess at the time when erroneous insertion happens, thus effectively preventing any erroneous insertion in an improper orientation. Furthermore, since the tongue portion is properly guided by the recess when the plug is connected to the receptacle, the plug is prevented from being slantingly inserted into the receptacle.

Further, in the connector of the present invention, it is also preferred that the tongue portion is formed in the bottom surface of the shield case of the receptacle and the recess is formed in the bottom surface of the shield case of the plug.

According to the connector of the present invention described above, the tongue portion is prevented from bending by the presence of the substrate and therefore the receptacle is kept from any deformation which would otherwise be caused by the erroneous insertion.

Further, in the connector of the present invention, it is also preferred that the tongue portion is formed into a generally rectangular shape by cutting away left and right sides of the bottom surface of the shield case of the receptacle substantially up to a middle part thereof along a plug insertion direction.

According to the connector of the present invention described above, it is possible to form the tongue portion constituting a part of the erroneous insertion preventing and guiding means by using the bottom surface of the shield case of the receptacle. Therefore, it is possible to avoid any increase in the height and size of the receptacle that would otherwise be caused by the provision of the erroneous insertion preventing means. This makes it possible to miniaturize the size and height of the connector.

Furthermore, in the connector of the present invention, it is also preferred that the tongue portion is formed into a generally trapezoidal shape by cutting away left and right sides of the bottom surface of the shield case of the receptacle substantially up to a middle part thereof along a plug insertion direction. This enables the tongue portion of the receptacle to be readily guided by and inserted into the recess of the plug.

In the connector of the present invention, it is preferred that the shield case of the receptacle and the shield case of the plug are formed of a metal plate and the metal plate forming the bottom surface of the shield case of the receptacle has a thickness greater than a thickness of the metal plate forming the bottom surface of the shield case of the plug such that a gap can be created between the bottom surface of the plug and a top surface of the substrate, when the plug is connected to the receptacle under a condition that the receptacle is mounted on the substrate. This enables the plug to be connected to the receptacle with no interference with the substrate.

Moreover, it is also preferred that an elastic locking piece is formed on a top surface of the shield case of the receptacle and a recess is formed on a top surface of the shield case of the plug, the elastic locking piece adapted to engage with the recess formed on the top surface of the shield case of the plug when the plug is connected to the receptacle. This prevents the plug from being inadvertently removed from the receptacle.

Another aspect of the present invention is directed to a receptacle for connector which is to be mounted on a substrate when in use and to which a plug having a shield case of a generally angulate tubular shape is adapted to be connected. The shield case of the plug is provided with connection terminals therein and has a bottom surface. The receptacle includes a shield case of a generally angulate tubular shape having a bottom surface which is adapted to face the substrate when the receptacle is mounted thereon, and the shield case of the receptacle is provided with connection terminals therein. The shield case of the receptacle is configured so that the shield case of the plug is inserted into the shield case of the receptacle when the plug is connected to the receptacle, at which the connection terminals of the plug are electrically connected to the connection terminals of the receptacle. Further, a tongue portion is formed in the bottom surface of the shield case of the receptacle and a recess is formed in the bottom surface of the shield case of the plug so that the tongue portion of the shield case of the receptacle is fitted into the recess of the shield case of the plug when the plug is connected to the receptacle.

Further, another aspect of the present invention is directed to a plug for connector which is to be connected to a receptacle having a shield case of a generally angulate tubular shape. The receptacle is adapted to be mounted on a substrate when in use, and the shield case of the receptacle is provided with connection terminals therein and having a bottom surface which is adapted to face the substrate when the receptacle is mounted on the substrate. The plug includes a shield case of a generally angulate tubular shape having a bottom surface, and the shield case of the receptacle is provided with connection terminals therein. The shield case of the plug is configured so that the shield case of the plug is inserted into the shield case of the receptacle when the plug is connected to the receptacle, at which the connection terminals of the plug are electrically connected to the connection terminals of the receptacle. Further, a recess is formed in the bottom surface of the shield case of the plug and a tongue portion is formed in the bottom surface of the shield case of the receptacle so that the tongue portion of the shield case of the receptacle is fitted into the recess of the shield case of the plug when the plug is connected to the receptacle.

These and other objects, structures and results of the present invention will be apparent more clearly when the following detailed description of the preferred embodiments is considered taken in conjunction with the appended drawings.

DETAILED DESCRIPTION OF THE PREFERRED EMBODIMENTS

Figure 1:
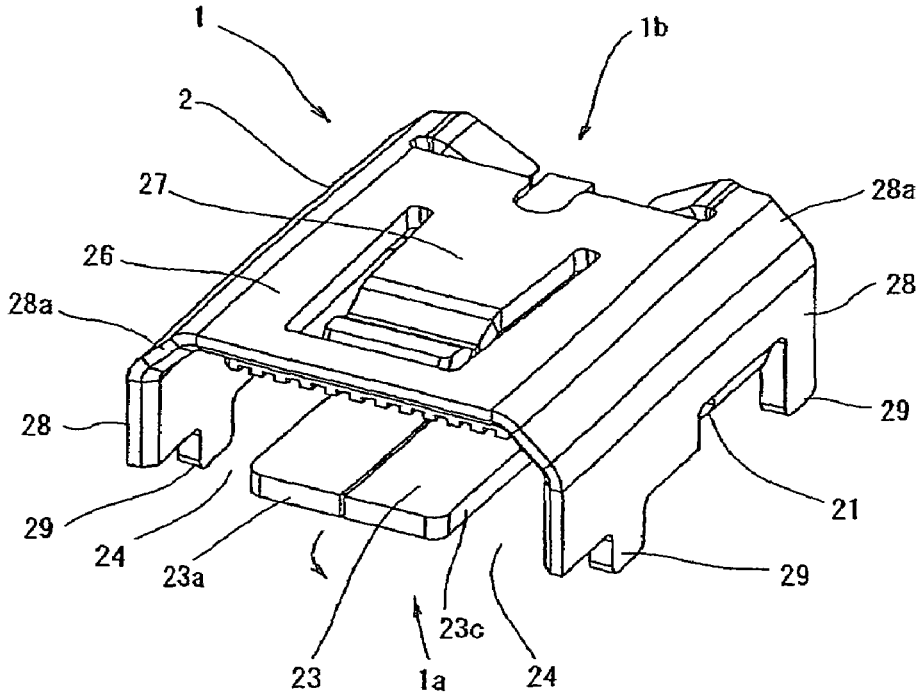
FIG. 1 is a perspective view illustrating a receptacle 1 employed in a connector according to an embodiment of the present invention, with a substrate 11 removed for clarity.

Hereinafter, preferred embodiments of a connector according to the present invention will be described with reference to the accompanying drawings.

As shown in the figures, the connector of this embodiment includes a receptacle 1 to be mounted on a substrate 11 and a plug 5 adapted to be connected to the receptacle 1. The receptacle 1 has a shield case 2 of a generally angulate tubular shape, and the shield case 2 is provided with a dozen of connection terminals 31 therein. The plug 5 has a shield case 6 of a generally angulate tubular shape, and the shield case 6 is provided with a dozen of connection terminals 71 therein. The shield case 6 is adapted to be inserted in the shield case 2 of the receptacle 1. When the shield case 6 of the plug 5 is inserted into the shield case 2 of the receptacle 1 (that is, when the plug 5 is connected to the receptacle 1), the connection terminals 71 of the plug 5 are electrically connected to the connection terminals 31 of the receptacle 1. One of the features of this connector resides in the structure where a tongue portion 23 is provided in a bottom surface (bottom wall) 21, that is, the surface of the shield case 2 of the receptacle 1 which faces the substrate 11 when the receptacle 1 is mounted on the substrate 11, and a recess 63 is formed in a bottom surface (bottom wall) 61 of the shield case 6 of the plug 5. The tongue portion 23 and the recess 63 are configured so that they are mutually fitted together when the plug 5 is connected to the receptacle 1 and thus serve as an erroneous insertion preventing and guiding means of the present invention. Referring first to FIGS. 1 through 5, a description will be made to the receptacle 1 employed in the connector of this embodiment.

Figure 2:
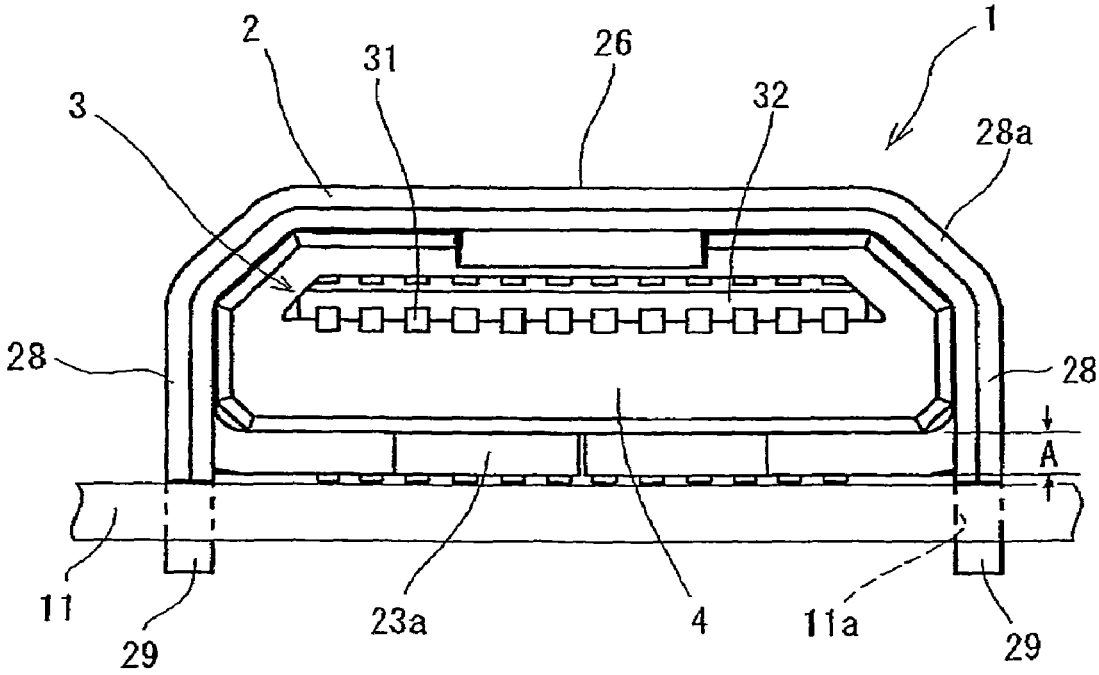
FIG. 2 is a front view of the receptacle 1 shown in FIG. 1.
Figure 3:
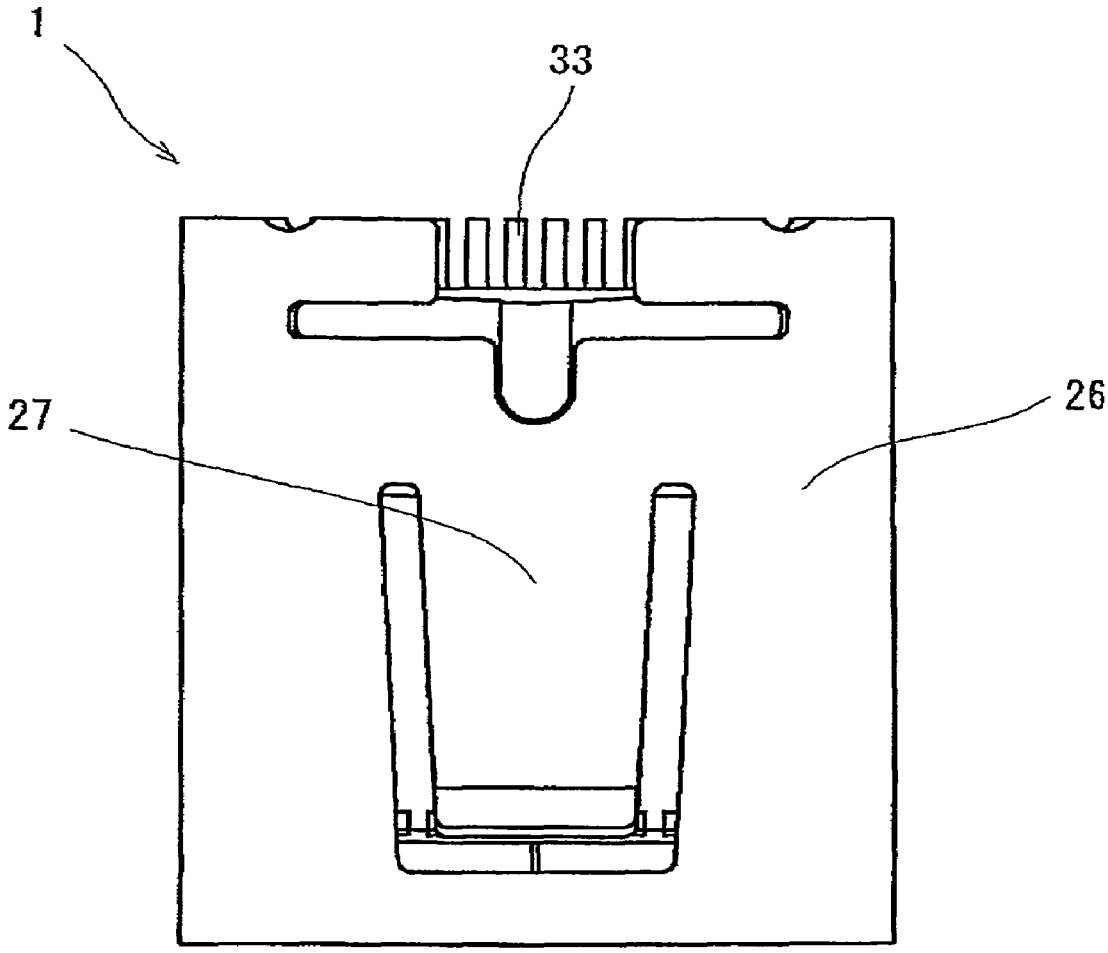
FIG. 3 is a top view of the receptacle 1 shown in FIG. 1.
Figure 5:
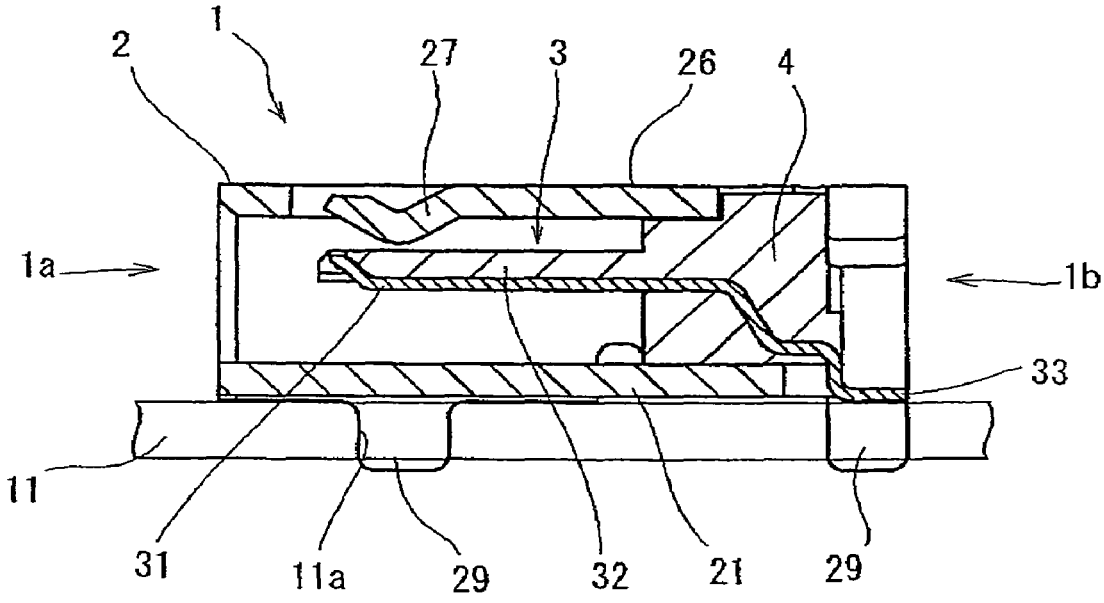
FIG. 5 is a vertical cross-sectional view of the receptacle 1 shown in FIG. 1.

The receptacle 1 includes the shield case 2 of a generally angulate tubular shape, a connection terminal portion 3 provided inside the shield case 2 and a housing 4 disposed inside the shield case 2. As shown in FIGS. 2 and 5, the receptacle 1 is adapted to be mounted on a substrate 11.

The shield case 2 is produced by blanking a sheet of electrically conductive metal plate into a predetermined shape and then bending the same into a generally angulate tubular shape. The shield case 2 has a bottom surface 21 (bottom wall) which is adapted to face the substrate 11 when the receptacle 1 is mounted on the substrate 11 (see FIG. 4), a top surface 26 lying at the opposite side from the bottom surface 21, and side surfaces 28 disposed between the bottom surface 21 and the top surface 26.

Figure 4:
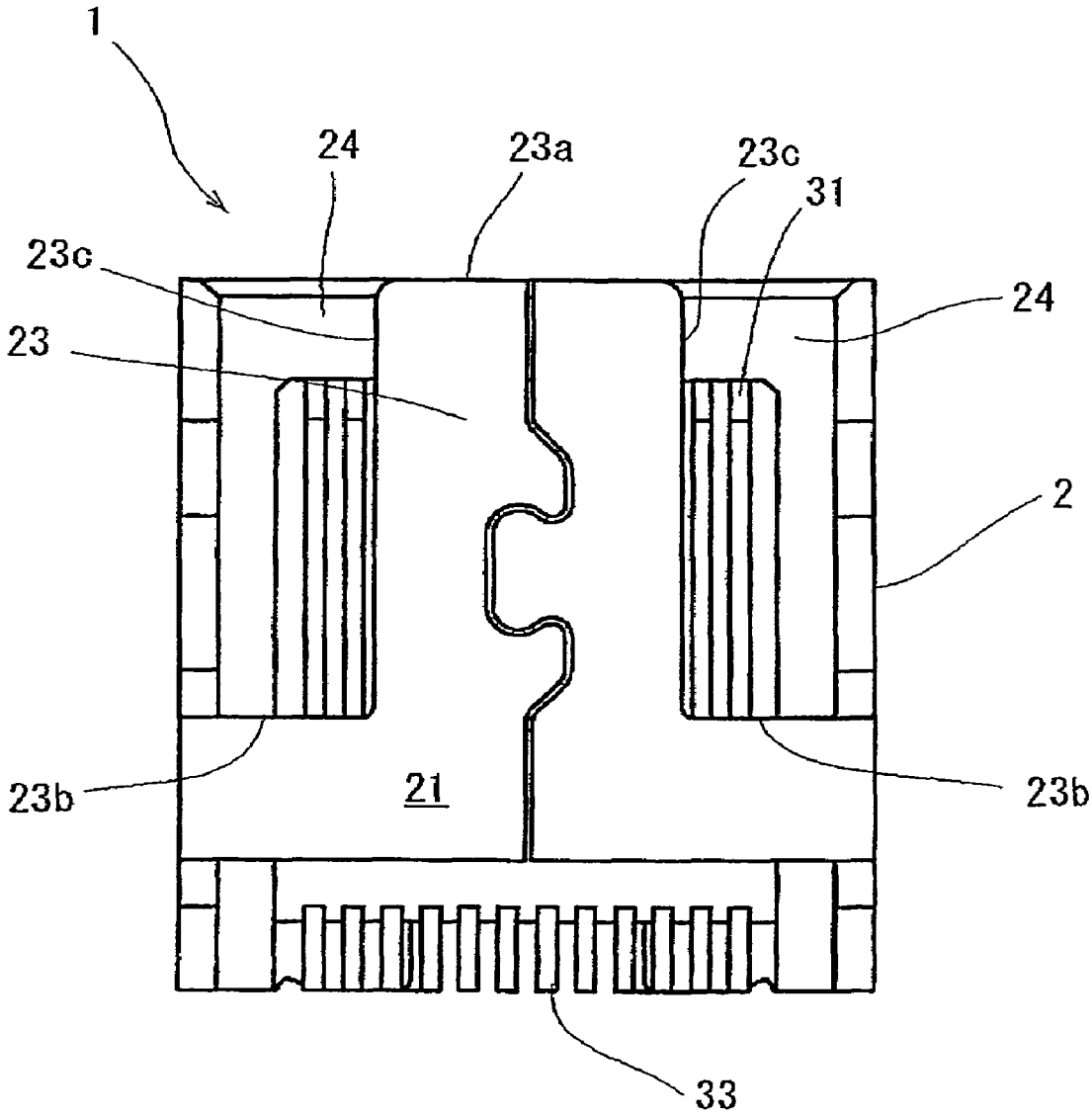
FIG. 4 is a bottom view of the receptacle 1 shown in FIG. 1.

As shown in FIG. 4, the left and right sides of the bottom surface 21 are cut away from the front end thereof to around the middle part along a plug insertion direction, thereby forming two cutout portions 24. This leaves a generally rectangular tongue portion 23 between the two cutout portions 24. The tongue portion 23 has a tip end portion 23*a* positioned at a receptacle opening 1*a*, a base end portion 23*b* lying adjacent to a rear surface portion 1*b* of the receptacle 1 and lateral side portions 23*c* extending along the both sides of the tongue portion 23. As will be described later, at the time when the plug 5 is connected to the receptacle 1, the tongue portion 23 is inserted or fitted into the recess 63 formed in the bottom surface 61 of the shield case 6 of the plug 5. Under this condition, the tip end portion 23*a*, the base end portion 23*b* and the lateral side portions 23*c* of the tongue portion 23 make contact with a rear end portion 63*a*, a front opening portion 63*b* and lateral side portions 63*c* of the recess 63, respectively.

The metal plate forming the bottom surface 21 of the shield case 2 has a thickness (designated by reference character "A" in FIG. 2) greater than the thickness (designated by reference character "B" in FIG. 7) of the metal plate which forms the bottom surface 61 of the shield case 6 of the plug 5 described later. Such a difference in the plate thickness creates a small gap between the bottom surface 61 of the plug 5 and the top surface of the substrate 11, when the plug 5 is connected to the receptacle 1 in a state that the latter is mounted on the substrate 11. This enables the plug 5 to be connected to the receptacle 1 without interference with the substrate 11.

Referring back to FIG. 1, an elastic locking piece 27 is formed substantially at the center of the top surface 26 of the shield case 2. The elastic locking piece 27 may be formed by notching or cutting out the top surface 26. As described below, when the plug 5 is connected to the receptacle 1 as described later, the elastic locking piece 27 engages with a recess 67 formed on a top surface 66 of the shield case 6 of the plug 5 (see FIG. 6).

As illustrated in FIG. 1, each of the side surfaces 28 of the shield case 2 of the receptacle 1 has a "c"-shaped surface 28*a* formed at the respective top corner parts thereof and a pair of engagement lugs 29 provided at the respective lower end parts thereof. The "c"-shaped surface 28*a* has a shape corresponding to the shape of a "c"-shaped surface 68*a* formed on each of the side surfaces 68 of the shield case 6 of the plug 5 as described later (see FIG. 7).

The engagement lugs 29 are portions for securing the receptacle 1 to the substrate 11. Namely, when the receptacle 1 is mounted on the substrate 11 as shown in FIGS. 2 and 5, the engagement lugs 29 are fitted into the mounting holes 11*a* of the substrate 11 and then soldered to the back side of the substrate 11.

As shown in FIGS. 2 and 5, the connection terminal portion 3 includes the connection terminals 31, a plate-shaped terminal support portion 32 for supporting the connection terminals 31 and a plurality of rear connection terminals 33. Each of the connection terminals 31 and each of the rear connection terminals 33 are integrally formed through the use of a single piece of electrically conductive metal and are arranged in such a manner that they extend through the housing 4, as illustrated in FIG. 5. Further, the connection terminals 31 are arranged on the underside of the terminal support portion 32 so that, when the plug 5 is connected to the receptacle 1, they will be brought into contact with the corresponding connection terminals 71 of a connection terminal portion 7 of the plug 5 (which will be described later in detail) to make electrical connection therebetween. The rear connection terminals 33 are soldered to the connection points (not shown) of the substrate 11 (see FIG. 5).

The housing 4 shown in FIG. 5 is a molding member made of a resin having insulation property, and is integrally molded with the connection terminal support portion 32. The housing 4 having such a structure is held by the shield case 2 of the receptacle 1.

Next, referring to FIGS. 6 through 10, a description will be made with regard to the plug 5 employed in the connector of this embodiment. The plug 5 includes a shield case 5 of a generally angulate tubular shape, a connection terminal portion 7 provided inside the shield case 6 and a plug body 51 provided on the base portion of the shield case 2. Further, the plug 5 is connected to a code 52 as can be seen in FIG. 6.

Figure 6:
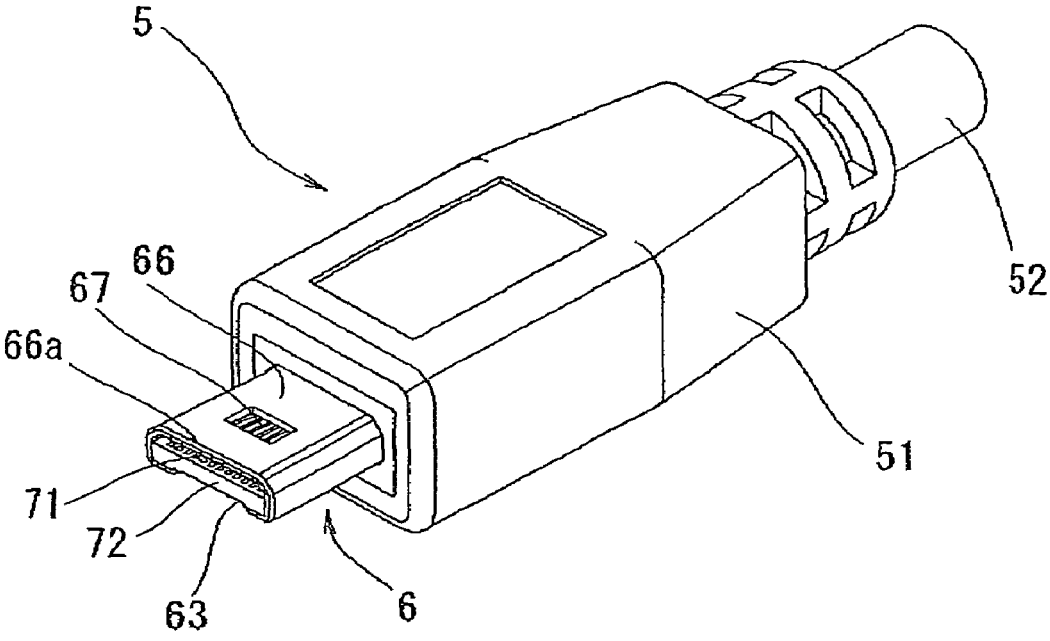
FIG. 6 is a perspective view showing a plug 5 employed in a connector according to an embodiment of the present invention.
Figure 7:
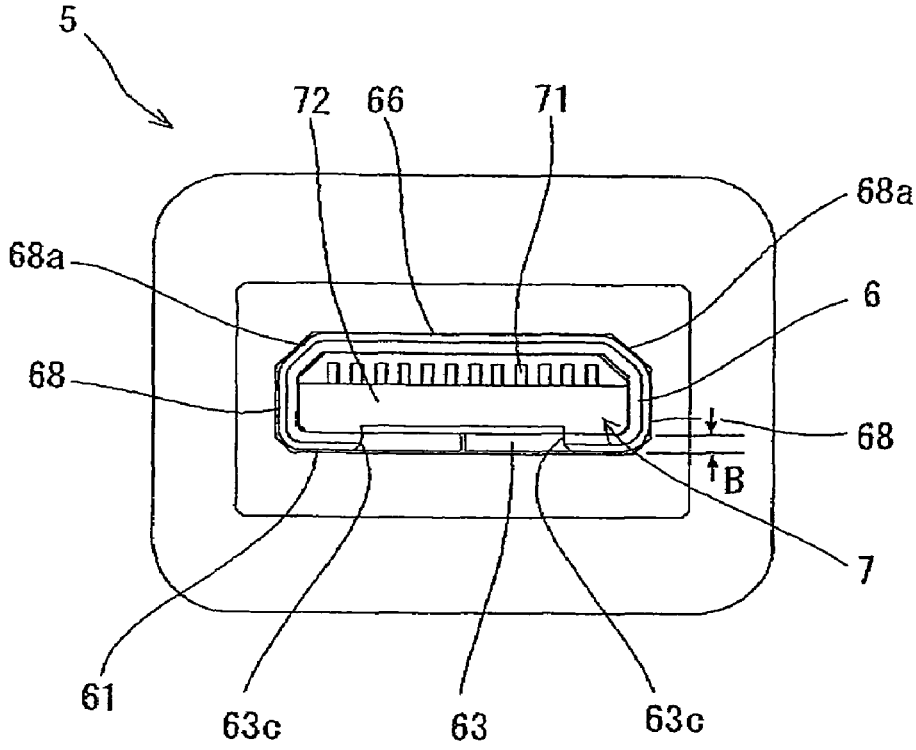
FIG. 7 is a front view of the plug 5 shown in FIG. 6.
Figure 8:
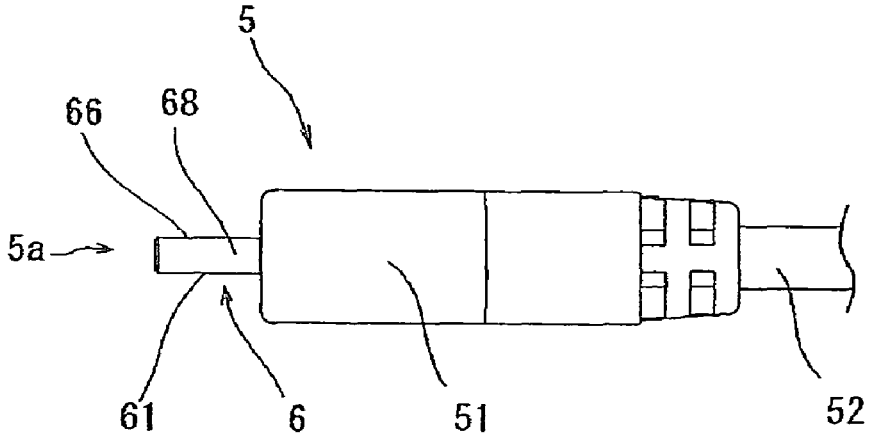
FIG. 8 is a side view of the plug 5 shown in FIG. 6.

As shown in FIGS. 6 and 7, the shield case 6 is produced by forming an electrically conductive metal plate into a generally angulate tubular shape. The shield case 6 has the bottom surface (bottom wall) 61 (see FIG. 7) corresponding to the bottom surface 21 of the shield case 2 of the receptacle 1, a top surface 66 positioned at the opposite side from the bottom surface 61, and side surfaces 68 disposed between the bottom surface 61 and the top surface 66.

Figure 10:
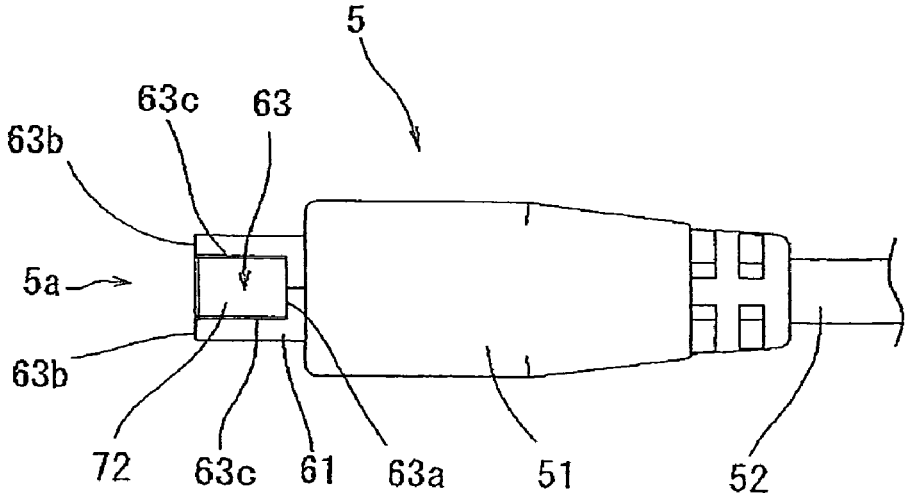
FIG. 10 is a bottom view of the plug 5 shown in FIG. 6.
Figure 11:
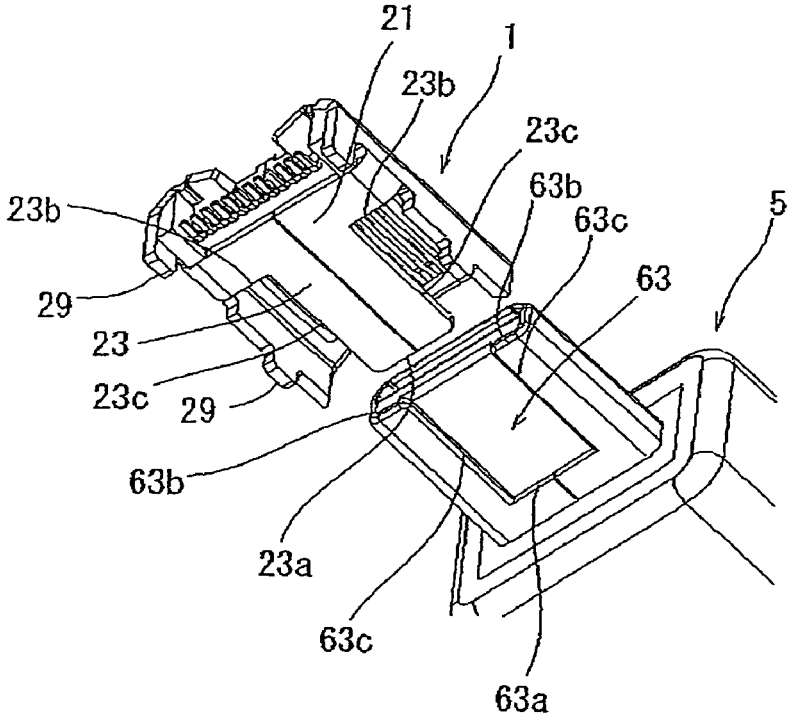
FIG. 11 is a perspective view showing a state immediately prior to the plug 5 shown in FIG. 6 being inserted into the receptacle 1 illustrated in FIG. 1, with a substrate 11 removed for clarity.
Figure 12:
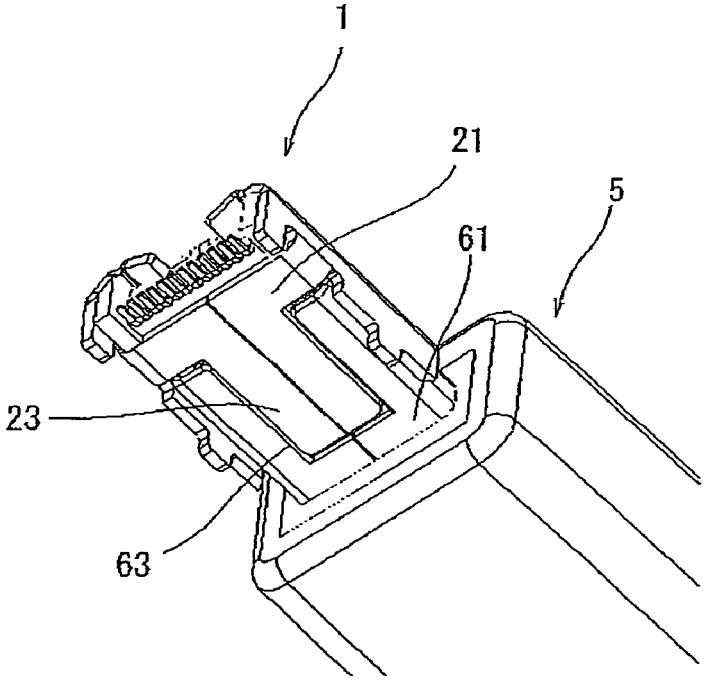
FIG. 12 is a perspective view showing a state that the plug 5 shown in FIG. 6 has been connected to the receptacle 1 illustrated in FIG. 1, with a substrate 11 removed for clarity.

As shown in FIG. 10, the recess 63 is formed at the center of the bottom surface 61 and is adapted to receive the tongue portion 23 of the receptacle 1 when the plug 5 is connected to the receptacle 1. The recess 63 has an opening portion 63*b* defined by the base portion 63*a* and the lateral side portions 63*c*. The opening portion 63*b* has substantially the same shape as the tongue portion 23 of the receptacle 1. As described above, the base portion 63*a*, the opening portion 63*b* and the lateral side portions 63*c* of the recess 63 make contact with the tip end portion 23*a*, the base end portion 23*b* and the lateral side portions 23*c* of the tongue portion 23, respectively, when the plug 5 is connected to the receptacle 1 (see FIGS. 11 and 12). Further, as described above, the metal plate forming the bottom surface 61 of the shield case 6 has a thickness (designated by reference character "B" in FIG. 7) smaller than the thickness (designated by reference character "A" in FIG. 2) of the metal plate which forms the bottom surface 21 of the shield case 2 of the receptacle 1. This enables the plug 5 to be connected to the receptacle 1 without interference with the substrate 11.

Figure 9:
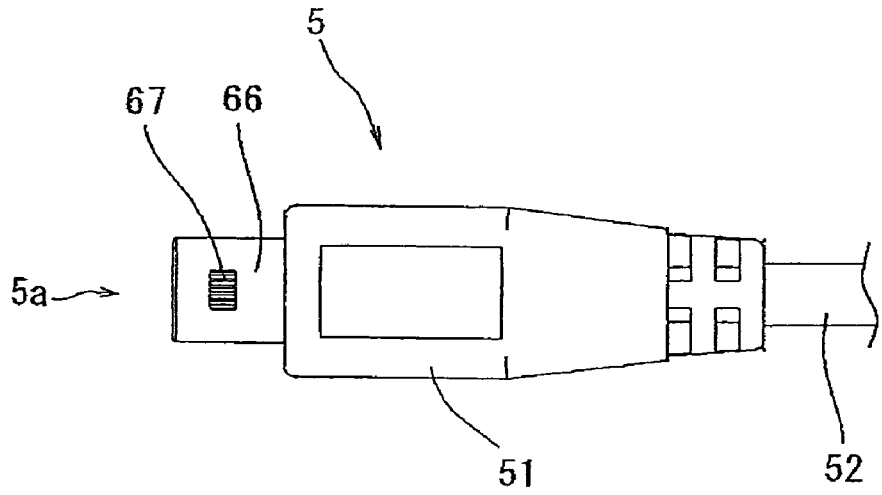
FIG. 9 is a top view of the plug 5 shown in FIG. 6.

Referring to FIG. 9, a recess 67 is formed substantially at the center of the top surface 66 of the shield case 6. At the time when the plug 5 is connected to the receptacle 1, the recess 67 engages with the elastic locking piece 27 formed on the top surface 26 of the shield case 2 of the receptacle 1, thereby assuring reliable connection between the plug 5 and the receptacle 1.

As shown in FIG. 7, each of the side surfaces 68 of the shield case of 6 of the plug 5 has a "c"-shaped surface 68*a* formed at the respective top corner parts thereof. The "c"-shaped surface 68*a* has a shape corresponding to the shape of the "c"-shaped surface 28*a* formed on each of the side surfaces 28 of the shield case 2 of the receptacle 1. The connection terminal portion 7 shown in FIG. 7 includes the plurality of connection terminals 71 and a terminal support portion 72 for supporting the connection terminals 71. The plurality of connection terminals 71 are connected to individual wires (not shown) of the cord 52 within the plug body 51.

Hereinbelow, a description will be made with regard to the operation and advantageous effects provided by the present embodiment.

In this embodiment, the plug 5 is connected to the receptacle 1 by inserting the shield case 6 of the plug 5 into the shield case 2 of the receptacle 1. In the process of such insertion, the tongue portion 23 serving as an erroneous insertion preventing and guiding means is guided by and fitted into the recess 63. This ensures that the shield case 6 of the plug 5 is thoroughly and reliably inserted into the shield case 2 of the receptacle 1. Furthermore, due to the fact that the tongue portion 23 is guided by the recess 63, the plug 5 is prevented from being slantingly or erroneously inserted into the receptacle 1. In the meantime, if an erroneous insertion is attempted by invertedly orienting the bottom surface 61 of the plug 5 to face the top surface 26 of the receptacle 1, the top end portion 66*a* (see FIGS. 6 and 7) of the shield case 6 of the plug 5 will interfere with the tip end portion 23*a* of the tongue portion 23, thus making it impossible to insert the plug 5 into the receptacle 1. This ensures that the plug 5 is prevented from being erroneously inserted into the receptacle 1 in an inverted orientation.

Moreover, provision of the "C"-shaped surfaces 28*a* and 68*a* in the receptacle 1 and the plug 5 of the present embodiment can more effectively prevent occurrence of the erroneous insertion in the inverted orientation. In this regard, it is noted that, although the "C"-shaped surfaces 28*a* and 68*a* are employed in the present embodiment, they are not essential to the present invention and therefore may be eliminated.

The tongue portion 23 is formed on the bottom surface 21 of the shield case 2 of the receptacle 1 and therefore the lower surface of the tongue portion 23 is supported by the substrate 11 even if the plug 5 is erroneously inserted in an inverted orientation (see FIG. 2). This prevents the tongue portion 23 from being bent downwardly (in the direction getting closer to the substrate 11 as indicated by an arrow in FIG. 1). Therefore, even when the plug 5 is erroneously inserted in an inverted orientation with a significantly great force, the tongue portion 23 is prevented from bending and the receptacle 1 is kept from any deformation which would otherwise be caused by the erroneous insertion.

The tongue portion 23 is formed into a generally rectangular shape by cutting away the bottom surface 21 of the shield case 2 of the receptacle 1. This makes it unnecessary for the receptacle 1 to have a separate space for forming the erroneous insertion preventing protrusions like the prior art, which helps to make the receptacle 1 to have lower height and smaller size.

Further, as described above, the metal plate forming the bottom surface 21 of the shield case 2 has a thickness greater than the thickness of the metal plate which forms a bottom surface 61 of the shield case 6 of the plug 5 and therefore a small gap is created between the bottom surface 61 of the plug 5 and the top surface of the substrate 11 when the plug 5 is connected to the receptacle 1. This makes it possible to connect the plug 5 to the receptacle 1 without interference with the substrate 11.

Once the plug 5 is correctly inserted into the receptacle 1, the elastic locking piece 27 of the receptacle 1 engages with the recess 67 formed on the top surface 66 of the plug 5. This prevents the plug 5 from being removed from the receptacle 1 inadvertently.

In the embodiment described above, the receptacle 1 is designed to have the tongue portion 23 and the plug 5 is configured to have the recess 63. However, alternatively, the plug may have a tongue portion and the receptacle may have a recess corresponding to the tongue portion of the plug. Further, although the connector of the foregoing embodiment is provided with a single tongue portion 23 and a single recess 63, the connector may have a plurality of tongue portions and a plurality of recesses.

Figure 13:
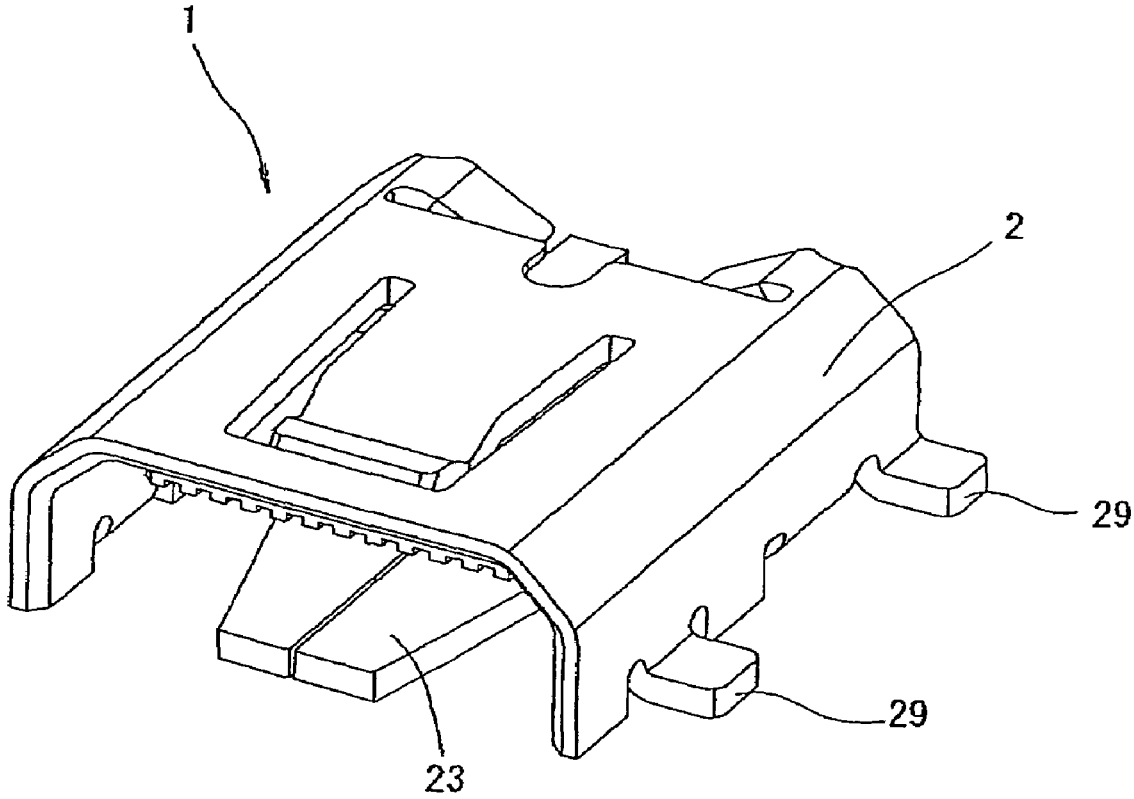
FIG. 13 is a perspective view illustrating a receptacle 1 employed in a connector according to another embodiment of the present invention, with a substrate 11 removed for clarity.

Further, although the tongue portion 23 of the foregoing embodiment is formed into a generally rectangular shape, no restriction is imposed on the shape of the tongue portion 23 as far as it allows the receptacle 1 and the plug 5 to be connected together. FIG. 13 illustrates a receptacle 1 according to another embodiment of the present invention wherein the receptacle 1 has a tongue portion 23 formed into a generally trapezoidal shape for easier insertion into the recess of the plug 5. In this embodiment, it is preferred that the plug 5 has a trapezoidal recess corresponding to the shape of the tongue portion 23.

Still further, according to the receptacle 1 of the other embodiment shown in FIG. 13, the shield case 2 has engagement lugs 29 extending laterally outwardly from the respective side surfaces 28 in a horizontal direction. This type of engagement lugs 29 is in preparation for the surface mounting of the receptacle 1 on the substrate 11.

Finally, it should be understood that the present invention is not limited to the preferred embodiments described hereinabove and, needless to say, a variety of modifications or variations may be made without departing from the scope of the invention defined in the following claims.

Further, it is also to be understood that the present disclosure relates to subject matter contained in Japanese Patent Application No. 2005-255588 (filed on Sep. 2, 2005) which is expressly incorporated herein by reference in its entirety.

What is claimed is:

1. A connector comprising:

a receptacle mounted on a substrate wherein the receptacle has a shield case of a generally angulate tubular shape having a bottom surface that faces the substrate when the receptacle is mounted thereon wherein the shield case of the receptacle has connection terminals therein;

a plug connected to the receptacle wherein the plug has a shield case of a generally angulate tubular shape having a bottom surface wherein the shield case of the plug has connection terminals therein wherein the shield case of the plug is configured so that the shield case of the plug is inserted into the shield case of the receptacle when the plug is connected to the receptacle wherein the connection terminals of the plug are electrically connected to the connection terminals of the receptacle; and erroneous insertion preventing and guiding means provided in the bottom surface of the shield case of the receptacle and the bottom surface of the shield case of the plug for preventing any occurrence of erroneous insertion therebetween when the plug is connected to the receptacle while properly guiding the shield case of the plug into the shield case of the receptacle wherein the erroneous insertion preventing and guiding means has at least one tongue portion formed in one of the bottom surfaces of the shield case of the receptacle and the shield case of the plug and a recess corresponding to the tongue portion and formed in the other bottom surface of the shield case of the receptacle or the shield case of the plug wherein the tongue portion is fitted into the recess when the plug is connected to the receptacle wherein the tongue portion is formed in the bottom surface of the shield case of the receptacle and the recess is formed in the bottom surface of the shield case of the plug wherein the tongue portion is formed into a generally rectangular shape by cutting away left and right sides of the bottom surface of the shield case of the receptacle substantially up to a middle part thereof along a plug insertion direction.

2. A connector comprising:

a receptacle mounted on a substrate wherein the receptacle has a shield case of a generally angulate tubular shape having a bottom surface that faces the substrate when the receptacle is mounted thereon wherein the shield case of the receptacle has connection terminals therein;

a plug connected to the receptacle wherein the plug has a shield case of a generally angulate tubular shape having a bottom surface wherein the shield case of the plug has connection terminals therein wherein the shield case of the plug is configured so that the shield case of the plug is inserted into the shield case of the receptacle when the plug is connected to the receptacle wherein the connection terminals of the plug are electrically connected to the connection terminals of the receptacle; and erroneous insertion preventing and guiding means provided in the bottom surface of the shield case of the receptacle and the bottom surface of the shield case of the plug for preventing any occurrence of erroneous insertion therebetween when the plug is connected to the receptacle while properly guiding the shield case of the plug into the shield case of the receptacle wherein the erroneous insertion preventing and guiding means has at least one tongue portion formed in one of the bottom surfaces of the shield case of the receptacle and the shield case of the plug and a recess corresponding to the tongue portion and formed in the other bottom surface of the shield case of the receptacle or the shield case of the plug wherein the tongue portion is fitted into the recess when the plug is connected to the receptacle wherein the tongue portion is formed in the bottom surface of the shield case of the receptacle and the recess is formed in the bottom surface of the shield case of the plug wherein the tongue portion is formed into a generally trapezoidal shape by cutting away left and right sides of the bottom surface of the shield case of the receptacle substantially up to a middle part thereof along a plug insertion direction.

3. A connector comprising:

a receptacle mounted on a substrate wherein the receptacle has a shield case of a generally angulate tubular shape having a bottom surface facing the substrate when the receptacle is mounted thereon wherein the shield case of the receptacle has connection terminals therein;

a plug connected to the receptacle wherein the plug has a shield case of a generally angulate tubular shape having a bottom surface wherein the shield case of the plug has connection terminals therein wherein the shield case of the plug is configured so that the shield case of the plug is inserted into the shield case of the receptacle when the plug is connected to the receptacle wherein the connection terminals of the plug are electrically connected to the connection terminals of the receptacle wherein the shield case of the receptacle and the shield case of the plug are formed of a metal plate that forms the bottom surface of the shield case of the receptacle and has a thickness greater than a thickness of the metal plate forming the bottom surface of the shield case of the plug such that a gap is created between the bottom surface of the plug and a top surface of the substrate when the plug is connected to the receptacle under a condition that the receptacle is mounted on the substrate; and erroneous insertion preventing and guiding means in the bottom surface of the shield case of the receptacle and the bottom surface of the shield case of the plug for preventing any occurrence of erroneous insertion therebetween when the plug is connected to the receptacle while properly guiding the shield case of the plug into the shield case of the receptacle.

* * * * *